US005432590A

United States Patent [19]

Nomura et al.

[11] Patent Number: 5,432,590

[45] Date of Patent: Jul. 11, 1995

[54] IMAGE FORMING APPARATUS WITH ROTATABLE MEMBER PRESS-CONTACTED TO IMAGE BEARING MEMBER

[75] Inventors: Yoshiya Nomura, Tokyo; Hiroaki Miyake; Yoshiro Tsuchiya, both of Yokohama, all of Japan

[73] Assignee: Canon Kabushiki Kaisha, Tokyo, Japan

[21] Appl. No.: 287,411

[22] Filed: Aug. 9, 1994

Related U.S. Application Data

[63] Continuation of Ser. No. 703,767, May 21, 1991, abandoned.

[30] Foreign Application Priority Data

May 22, 1990 [JP] Japan ..... 2-132882

[51] Int. Cl.[6] ..... G03G 15/00

[52] U.S. Cl. ..... 355/200; 355/210; 355/271; 464/104

[58] Field of Search ..... 355/210, 211, 235, 200, 355/271, 277, 295, 290, 259, 309, 219; 74/333, 375, 337.5; 464/102–104

[56] References Cited

U.S. PATENT DOCUMENTS

| | | | |
|---|---|---|---|
| 3,106,078 | 10/1963 | Turinsky | 464/103 |
| 3,815,380 | 6/1974 | Esmay | 355/309 X |
| 4,050,803 | 9/1977 | McCarroll | 355/290 |
| 4,212,631 | 7/1980 | Franke et al. | 355/290 X |
| 4,384,859 | 5/1983 | Teramachi | 464/103 |
| 4,421,401 | 12/1983 | Kagiura et al. | 355/3 |
| 4,719,491 | 1/1988 | Katoh et al. | 355/235 |
| 4,829,335 | 5/1989 | Kanemitsu et al. | 355/211 |
| 4,835,565 | 5/1989 | Nagatsuna et al. | 355/259 |
| 5,010,370 | 4/1991 | Araya et al. | 355/271 X |
| 5,021,829 | 6/1991 | Johnson et al. | 355/271 X |
| 5,070,366 | 12/1991 | Tsuchiya | 355/219 |

FOREIGN PATENT DOCUMENTS

| | | |
|---|---|---|
| 2141520 | 12/1984 | European Pat. Off. . |
| 0251693 | 1/1988 | European Pat. Off. . |
| 58-187967 | 11/1983 | Japan . |
| 58-209763 | 12/1983 | Japan . |
| 1-199023 | 8/1989 | Japan . |
| 1199023 | 10/1989 | Japan . |
| 2-156280 | 6/1990 | Japan . |
| 02166470 | 6/1990 | Japan . |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

An image forming apparatus includes an image bearing member movable along an endless path; a helical gear, adjacent an end of the image bearing member, for transmitting a driving force to the image bearing member; a rotatable member contributable to image formation on the image bearing member and having a shaft urged toward the image bearing member; driving means for driving the shaft; and a coupler disposed between the driving means and the shaft of the rotatable member, and effective to transmit rotational force in a direction of the shaft substantially without transmitting force in a radial direction of the rotatable member.

20 Claims, 2 Drawing Sheets

IMAGE FORMING APPARATUS WITH ROTATABLE MEMBER PRESS-CONTACTED TO IMAGE BEARING MEMBER

The application is a continuation of application Ser. No. 07/703,767 filed May 21, 1991, now abandoned.

FIELD OF THE INVENTION AND RELATED ART

The present invention relates to an image forming apparatus such as a copying machine or printer or the like using an image formation process such as an electrophotographic process, an electrostatic recording system or a magnetic recording system.

Conventionally, a drum unit is constituted by an electrophotographic photosensitive drum and flanges integral with the photosensitive drum at the opposite longitudinal ends of the photosensitive drum. One or both of the flanges has a gear integral therewith, called a drum gear. The drum gear meshes with a drum driving gear, so that driving power is transmitted from a driving source such as motor through a drive transmission means to drive the photosensitive drum.

An image forming process means for forming an image on the photosensitive drum includes one or more of the following rollers:

(1) An image transfer roller which is rotated in the same peripheral direction and at the same peripheral speed as the image bearing member to press-contact the transfer material introduced between the image bearing member and the transfer roller to the surface of the image bearing member to sequentially transfer a transferable image (toner image) from the image bearing member onto a surface of the transfer material;

(2) A cleaning roller which is contacted to the surface of the image bearing member after the image transfer and is rotated at such a speed as to provide a sliding contact therebetween to remove residual toner or other contamination from the surface of the image bearing member to permit repetitive use of the image bearing member; and (3) A contact type charging roller which is rotated in the same direction and at the same speed as the periphery of the image bearing member or at a speed to provide the sliding contact therebetween, to uniformly charge the surface of the image bearing member to the positive or negative polarity or to uniformly discharge it.

The mechanism for permitting the pressure contact and the rotation of the rotatable member includes the bearings at the longitudinal opposite ends, the bearings being movable toward and away from the image bearing member, wherein pressing means such as springs act on the bearings to press-contact the roller to the surface of the image bearing member along the length thereof. In another type of the mechanism, a drive receiving gear is integrally mounted directly on the shaft of the roller, and the gear is meshed with one of drum gears of the photosensitive drum, or with an output gear of a driving gear train meshed with the drive gear, so as to rotate it at a predetermined rotational speed.

As described hereinbefore, the other one of the drum gears is meshed with a drum driving gear. In order to rotate the photosensitive drum smoothly, the drum driving gear and the drum gear are helical gears (U.S. Pat. Ser. No. 4,829,335).

The rotatable members such as the transfer roller, the cleaning roller or the contact charging roller are desirably stably contacted to the image bearing member at a constant pressure along the length.

If the pressure is not uniform along the length, problems result such as non-uniform image transfer in the case of the transfer roller, non-uniform cleaning in the case of the cleaning roller and non-uniform charging (discharging) in the case of the contact type charging roller. They are all influential to the quality of the output image.

When the roller has an integral drive receiving gear which is meshed with the driving gear, as in the conventional mechanism described above, the uniformity of the pressure therebetween along the length is adversely affected.

More particularly, when the driving force is being transmitted by the engagement between gears, the forces tending to push the gears away from each other, are applied in the direction perpendicular to the shaft of the gear, depending on the pressure angle of the gears. Therefore, when the drive receiving gear is integral with the roller which is meshed with the driving gear, a component of force, in the direction perpendicular to the shaft of the gear applied due to the meshing engagement between the drive receiving gear and the driving gear, is produced. Therefore, more or less force applies in the direction influential to the pressure between the roller and the image bearing member, more particularly, in the direction to increase the pressure at the gear meshing side or in the opposite direction tending to separate them.

It is very difficult in many cases to dispose the gear at a position non-influential to the pressure between the roller and the image bearing member, because of the usable gear and the rotational speed thereof.

For these reasons, the pressure between the roller and the image bearing member becomes non-uniform along the length of the roller (large at the gear side, and small at the opposite side, for example). Even if an attempt is made to adjust the balance of the pressure between the opposite ends of the roller by, for example, changing the pressure spring at one of the longitudinal ends, the adjustment would be practically very difficult.

The roller is generally constituted by an elastic member such as rubber and a penetrating shaft (core metal) made of iron or aluminum. When it is press-contacted to the photosensitive drum, it is slightly compressed. Therefore, where the driving gear is directly mounted on the roller and is meshed with the drum gear to transmit the driving force to the roller, the deformation by the compression upon the press-contact to the photosensitive drum increases if the elasticity of the roller is low. This result in the approach of the shaft of the roller toward the photosensitive drum. If this occurs, the distance between the drum gear and the driving gear of the roller deviates from the optimum distance, with the result of non-uniform rotation. If the distance between the drum gear and the driving gear of the roller further decreases, the top end of the gear and the bottom end interfere, with the result of remarkably non-uniform rotation which leads to improper images. Thus, if the distance between the drum gear and the driving gear is not proper, the wearing of the drum gear and the driving gear of the roller is significant, even to the extent of damage thereof.

When the drive gear of the roller and the drum gear are spur gears, non-uniform rotation tends to occur because of unavoidable tolerance in the manufacturing of the gears. The roller is press-contacted to the photosensitive drum while it is rotated. Thus, there exists a large friction force between the roller and the photosensitive drum. Therefore, non-uniformity resulting from the gear is easily transmitted from the roller to the photosensitive drum. Particularly when it is rotated at a relatively high speed, the non-uniformity produces vibration. This produces pitch non-uniformity on the image.

SUMMARY OF THE INVENTION

Accordingly, it is a principal object of the present invention to provide an image forming apparatus wherein a rotatable member is press-contacted to an image bearing member with a pressure uniform along the length thereof.

It is another object of the present invention to provide an image forming apparatus wherein non-uniformity in the rotation of the image bearing member and the rotatable member is reduced to provide good images.

According to an aspect of the present invention, there is provided an image forming apparatus, including an image bearing member movable along an endless path; a helical gear, adjacent an end of the image bearing member, for transmitting a driving force to the image bearing member; a rotatable member facilitating image formation on the image bearing member and having a shaft urged toward the image bearing member; driving means for driving the shaft; and coupling means, disposed between the driving means and the shaft of the rotatable member, and effective to transmit rotational force in a direction of the shaft substantially without transmitting force in a radial direction of the rotatable member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, embodiments of the present invention will be described.

Figure 4:
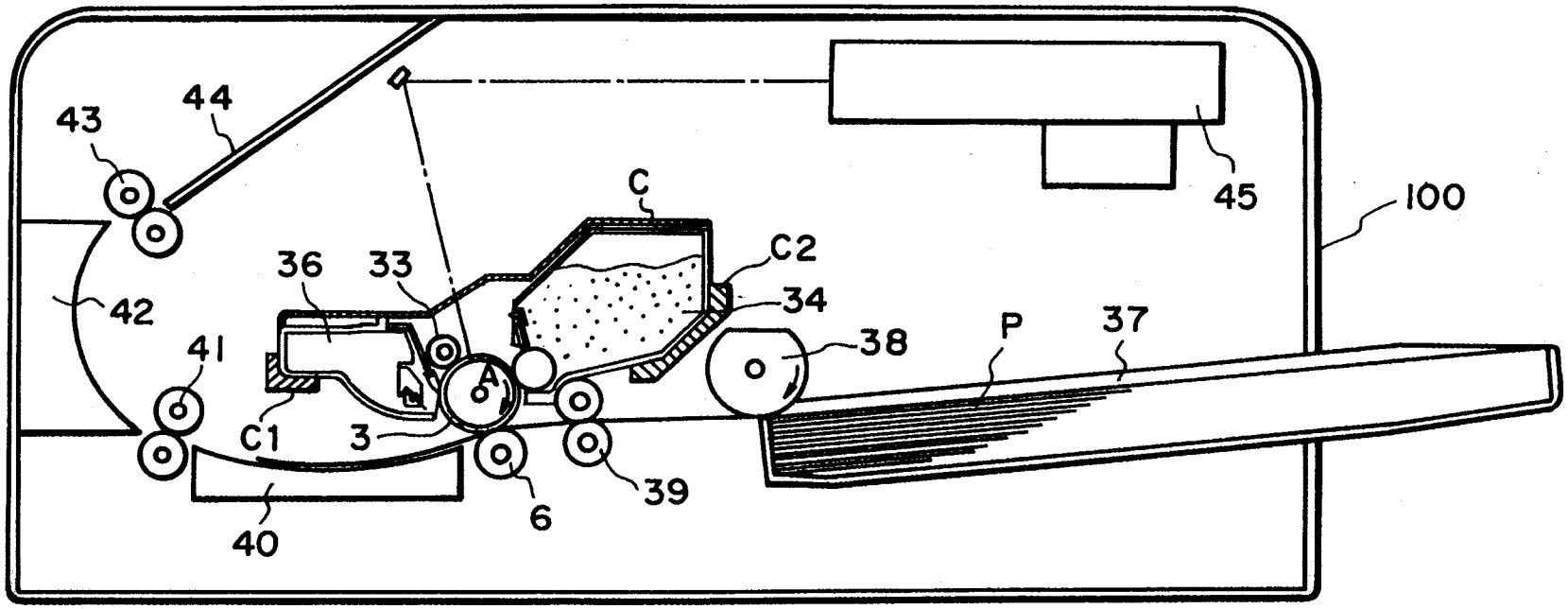
FIG. 4 is a sectional view of an image forming apparatus according to an embodiment of the present invention.

Referring to FIG. 4, there is shown a laser beam printer as an exemplary image forming apparatus according to an embodiment of the present invention.

A photosensitive drum 3 is rotated in the clockwise direction A. During its rotation, it is uniformly charged by a charging roller 33 contacted thereto. A video signal is supplied from an unshown controller to a laser scanning optical unit 45. The laser beam is projected onto the exposure position of the photosensitive drum 3 by way of reflection mirrors, so that a latent image is formed. The latent image is developed into a toner image by a developing sleeve of a developing device 34 carrying a thin layer of toner.

A transfer material P stacked on a cassette 37 is fed out by a pick-up roller 38 in response to a signal from a central processing unit (CPU) not shown. The transfer material P is supplied to the transfer station by a registration roller 39 with a controlled timing in relation to the toner image on the photosensitive member 3. In the transfer station, the toner image is transferred from the photosensitive member 3 onto the transfer material by the transfer roller 6. The transfer material P is then conveyed along a conveyance guide 40 to a fixing device where it is subjected to an image fixing operation by a heated fixing roller 41. It is discharged to a sheet discharging portion 46 along a conveyance guide and by discharging rollers 43.

On the other hand, the photosensitive drum 3, after being subjected to the image transfer operation, is cleaned by a cleaning device having a cleaning roller contacted to the photosensitive drum 3, so that the residual toner is removed therefrom and that it is prepared for the next image formation.

The charging roller photosensitive drum 3, and the developing device 34 and the cleaning device 36 which are image forming process means actable on the photosensitive drum 3, constitute an integral process cartridge C. The process cartridge C is detachably mountable to the main assembly 100 of the apparatus in a direction perpendicular to the sheet of the drawing of FIG. 4 along guide rails C1 and C2 fixed on the main assembly. The process cartridge C is not required to contain all of the above-mentioned process means but may require only the photosensitive drum 3 and at least one of the process means actable on the photosensitive drum 3.

Figure 1:
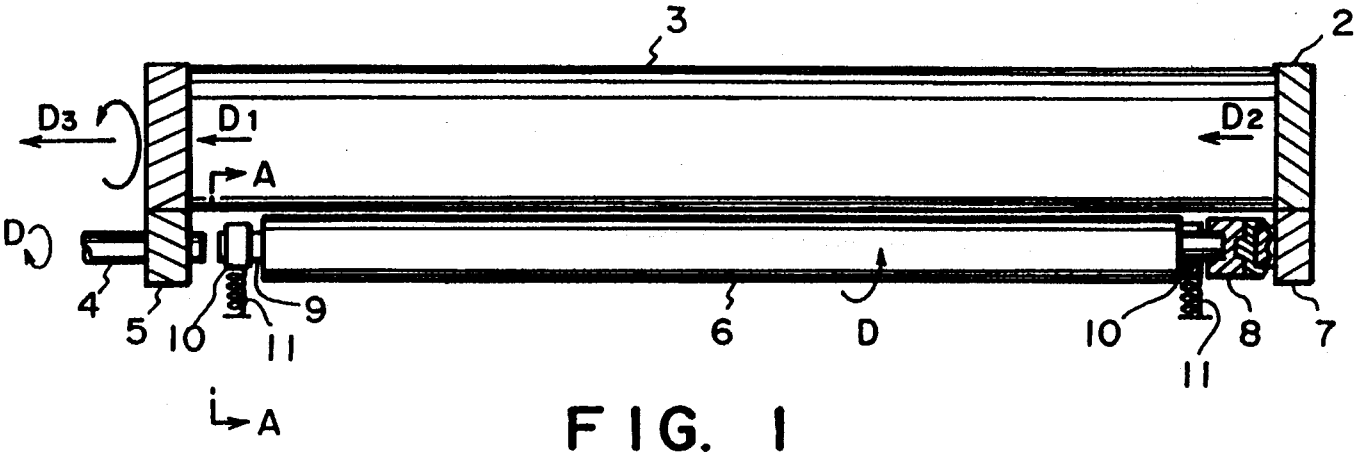
FIG. 1 shows a rotatable member and an image bearing member, according to an embodiment of the present invention.

FIG. 1 shows a driving mechanism for the photosensitive drum 3 and the transfer roller 6 usable with the image forming apparatus of FIG. 4.

To one longitudinal end of the photosensitive drum 3, a helical gear 1 integral with the flange is fixed, and to the other end, a second helical gear 2 integral with the flange is fixed. The respective directions of the twist angles of the helical gears are opposite from each other.

A drum driving gear in the form of a helical gear is fixed to a core metal 4. It functions to transmit the driving force from an unshown motor to rotate the photosensitive drum 3 in the counterclockwise direction as seen from the left side of FIG. 1 (direction of the arrow in the Figure). At this time, the photosensitive drum 3 receives thrust force D1 by the drum driving gear 5 toward the left.

The first helical gear 2 rotates in response to the rotation of the photosensitive drum 3 to transmit the drive to the second helical gear 7, and rotates the transfer roller 6 by way of an Oldham's coupling 8. At this time, the helical gear 7 receives thrust force T toward the right by the helical gear 2, so that the photosensitive drum 3 receives force D2 toward the left as a reaction force. Thus, the force D1 received by the photosensitive drum 3 is a combination force or resultant force D3 of the force D1 and the force D2. Accordingly, the photosensitive drum or the process cartridge having the photosensitive drum is moved to abut a reference surface of the main assembly, so that the position does not vary when it is rotated.

The transfer roller 6 is of elastic material such as chloroprene or EPDM, for example (soft rubber roller having rubber hardness of approximately 25 degrees). It is press-contacted to the drum 3 at a predetermined pressure by pressing means which will be described hereinafter. In addition, a driving mechanism which will be described hereinafter is effective to rotate it at the same peripheral speed and in the same peripheral direction D as the drum 3. The image transfer position is defined by a nip formed between the rotatable drum 3 and the rotatable transfer roller 6 of soft elastic rubber. To the transfer position, an unshown transfer material is supplied from an unshown sheet feeding station in synchronism with rotation of the drum 3. The transfer material thus supplied is pressed and contacted to the surface of the drum 3 by the transfer roller 6, while being passed through the transfer position. Thus, the toner image is sequentially transferred from the photosensitive drum 3 surface onto the transfer material surface by pressure transfer (by the pressure and the transfer bias applied to the transfer roller 6). As described hereinbefore, the transfer material passed through the transfer position is separated from the surface of the drum 3 and is supplied into an image fixing apparatus where it is subjected to the image fixing process.

Figure 2:
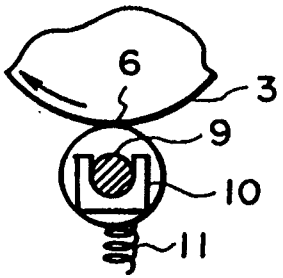
FIG. 2 is a sectional view taken along a line A—A of FIG. 1.

As shown in FIG. 2, the transfer roller 6 is supported rotatably by bearings 10 at the opposite longitudinal ends of the roller shaft 9. The bearings 10 are meshed with guiding slots extending toward the drum 3 in an unshown side plate of the main assembly so as to be sliding toward the drum 3 along the slot.

Springs 11 and 12 function as transfer roller pressing means for normally urging the bearings 10 along the guide slot toward the drum 3. By arranging the pressing means at the opposite sides, the transfer roller 6 is uniformly press-contacted to the drum 3 along the length of the transfer roller. This is stably maintained at all times. In addition, the width of the nip is made uniform along the length of the transfer position. This uniformity is effective to provide a constant transfer efficiency along the length thereof by the nip between the drum 3 and the transfer roller 6, thus providing uniform images.

Figure 3:
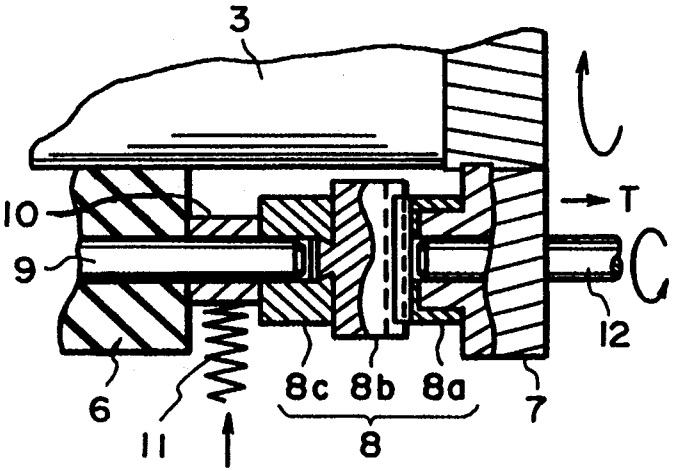
FIG. 3 is a partly sectional side view of a connecting portion and driving means of FIG. 1.

Referring to FIG. 3, there is shown an oldham's coupling functioning as coupling means between the helical gear (transfer roller 6 driving means) and the transfer roller.

A helical gear 7 is faced to a shaft width of one side of the transfer roller 9 shaft and functions as driving means for the transfer roller coupled through the oldham's coupling 8 functioning as the coupling means. The helical gear 7 is rotatable about a shaft 12 positioned and fixed on an unshown side plate of the main assembly of the apparatus.

The Oldham's coupling 8 comprises a first member **8*a* and a second member 8*b* which constitute slidable groove-projection engagement in a direction perpendicular to the axis thereof, and a third member 8*c* which constitutes another slidable groove-projection engagement in a direction perpendicular to the sliding direction between the second member 8*b* and the first member 8*a* at a side opposite from the first and second members 8*a* and 8*b*. The first member 8*a* is telescoped on the boss of the helical gear 7, and is securedly fixed on the gear 7 by an unshown screw. The third member 8*c* is telescoped on the end of the transfer roller shaft 9 by a screw, and the gear 7 and the shaft 9 are thus coupled through the Oldham's coupling 8**.

In this manner, the rotational center of the helical gear 7 and the axis of the roller shaft 9 are coupled for sliding movement therebetween.

Figure 5:
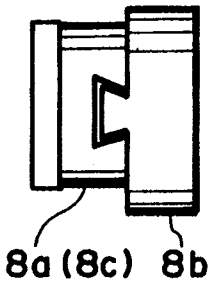
FIG. 5 is an enlarged top plan view of an oldham's coupling.

The engagement between the groove of the first member **8*a* and the projection of the second member 8*b*, and the engagement between the groove of the third member 8*c* and the projection of the second member 8*c* permit the sliding movement, as shown in FIG. 5, and therefore, grooves are larger than the associated projections. In addition, in order to prevent disegagement between the projections and the grooves, the width of the end of the projection is larger than the width of the bottom of the projection, and the width of the bottom of the groove is larger than the width of the opening inlet of the groove. Therefore, if there are forces to separate the first member and the second member, and to separate the second member and the third member, the driving force is reliably transmitted from the gear 7 to the transfer roller shaft 9. Therefore, if the thrust T is applied to the gear 7** as described hereinbefore, the drive transmission is further assured.

The rotational force of the helical gear 2 is transmitted to the transfer roller 6 through the helical gear 7, the Oldham's coupling 8 and the transfer roller shaft 9, so that the transfer roller 6 is rotated in the same peripheral direction D and at the same speed as the drum 3.

During the rotation with meshing engagement between the helical gear 2 of the drum and the helical gear 7 of the transfer roller, a force is produced that tends to separate gears 2 and 7 away from each other, that is, a component force perpendicular to the gear shaft. However, the component force produced in the helical gear 7 at the transfer roller 6 side is absorbed by the Oldham's coupling 8 which transmits in addition to the transmission at the center of the shaft as seen in the longitudinal direction of the shaft 9, and therefore, it is not transmitted to the transfer roller shaft 9, and therefore, to the transfer roller 6. In other words, the transfer roller 6 is rotated without influence of the component force resulting during the rotation of the gears 2 and 7.

Therefore, the press-contact state between the transfer roller 6 and the drum 3 can be defined by the pressure exerted by the pressing means 11 acting on the shaft at the right and left side of the transfer roller 6. The right and left pressing means 11 may be the same, by which the transfer roller 6 is maintained at all times at the press-contact position established between the opposite ends. In other words, the transfer efficiency along the length of the transfer position constituted by the nip between the drum 3 and the transfer roller 6 can be made constant, so that uniform images can be provided by uniform image transfer, because the width of the nip is made uniform along the length of the transfer position. It is easy to finely adjust the pressure at each of the end portions of the transfer roller 6. Since the pressing means 11 located at the opposite sides may be the same, the cost can be reduced with the advantage of less liability of erroneous assembling operation.

If the pressing means 11 at the opposite ends are the same, the pressing actions are the same, and therefore, even if the load changes during the rotation of the transfer roller 6 or even if the center of the transfer roller 6 deviates, a uniform press-contacted state between the opposite ends can be maintained stably between the transfer roller 6 and the drum 3.

Since the helical gear 7 of the driving gear for the transfer roller is connected with the transfer roller shaft 9 through the Oldham's coupling 8, even if the transfer roller shaft 9 and the shaft 12 of the gear 7 deviate at the respective axes, the driving force of the drum helical gear 2 is transmitted to the shaft 9, and therefore, to the transfer roller 6 without changing the angular speed. Accordingly, the transfer roller 6 is constantly and stably rotated at the same speed as the drum 3, so that the possibility of image deviation attributable to slippage between the transfer material and the drum 3 can be prevented.

The transmission of the rotation can be established smoothly, and the stability of the rotation of the transfer roller is significantly increased firstly because the drum gear 2 and the transfer roller gear 7 are both helical gears, and secondly because the distance between the axes of these gears is stabilized. For example, when the shaft 9 of the transfer roller 6 is directly connected with the helical gear without the Oldham's coupling 8, the distance between the axis of the helical gear 7 and that of the helical gear 2 deviates making it incapable of smooth rotational transmission because of the variation in the elasticity of the elastic material of the transfer roller 6 and because of the force tending to separate them produced during the rotation.

If the gears 7 and 2 are spur gears, non-uniform rotation occurs due to unavoidable manufacturing error of the spur gears even if the Oldham's coupling is used between the shaft 9 of the transfer roller 6 and the gear 7, and the distance between the shafts of the gears is maintained constant. Therefore, the transfer roller will be non-uniformly rotated because of the transmission of the non-uniformity through the Oldham's coupling and the transfer roller shaft.

If the direction of the twist angle of the gears 1 and 2 of the drum are made the same, the thrust forces d1 and d2 are directed toward the left and toward the right, respectively. Therefore, they are canceled. In this case, the resultant force d3 is small, so that the force for urging the photosensitive drum 3 in the predetermined direction becomes weak. When the thrust force d1 and the opposite force d2 vary significantly in their magnitudes for some reason or another, the directions of the forces may change, with the result of a change in the position of the photosensitive drum 3 in the thrust direction. Therefore, it is preferable that the direction of the twist angle is opposite in the helical gears at the opposite ends of the drum, as in FIG. 1 embodiment.

In this embodiment, the biased roller is used as the transfer roller. However, the features apply to the cleaning roller for removing the residual toner from the photosensitive member and/or charging electrode roller for charging the photosensitive member to a predetermined potential or the like.

The coupling means between the driving means and the roller may be in the form of a flexible coupling of a disk spring type, a flexible coupling of a diaphragm type or a coil spring type flexible coupling, if it has a function of dissipating the strain which is otherwise produced at the drive receiving side.

If the driving gear 7 of the roller is meshed with the helical gear 1 of the drum meshed with the drum driving gear 5, then the drum gear is meshed with three gears in total, because usually the drum gear is meshed with a sleeve gear or the like rotatable integral with the developing sleeve to rotate the developing sleeve. Then the load of the drum gear becomes large with the possibility of fatigue damage. Recent image forming apparatus is required to be smaller and lighter, and therefore, the photosensitive drum is required to be small in diameter. This means the load of the teeth of the drum gear is increased. From this standpoint, it is not desirable to transmit driving forces for plural means. Therefore, as shown in FIG. 1, it is desirable that a combination of a helical gear 1, for transmitting the drive to the drum, and a helical gear 2, for transmitting the drum drive to the roller, is preferable.

According to the present invention, described in the foregoing, the rotatable member of an image forming process means press-contacted to an image bearing member and driven for rotation, such as the transfer roller, the cleaning roller, the contactable charging roller or the like, is press-contacted substantially uniformly along the length of the roller at a predetermined pressure. The desirable state can be stably maintained. Thus, the deterioration of the quality of the output image due to non-uniform image transfer, non-uniform cleaning, non-uniform contact charging or the like can be avoided.

In addition, the non-uniform rotation attributable to error in the meshing engagement between the gears for the image bearing member and the rotatable member, can be reduced, so that the non-uniform rotation attributable to the variation in the distance between the axes of the image bearing member and the roller, can be prevented. This is effective to reduce non-uniformity in the pitch.

If the direction of the twist angle of the helical gear of the image bearing member is made opposite between one side and the other side, the thrust forces applied to the image bearing member are directed in the same direction, so that the image bearing member can be urged to a reference position by the rotational driving of the image bearing member. This is also effective to maintain the high quality of the images.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

a rotatable transfer member, having a shaft and arranged for contacting said image bearing member, for transferring an image from said image bearing member onto a transfer material;

a first helical gear mounted to said image bearing member adjacent an end thereof;

a second helical gear mounted on the shaft of said transfer member and arranged for meshing engagement with said first helical gear; and a third helical gear, provided adjacent an end of said image bearing member, for receiving a driving force from a driving helical gear;

coupling means, arranged between a shaft of said second helical gear and the shaft of said rotatable transfer member, for transmitting a rotational force from said second helical gear to said rotatable transfer member substantially without transmitting a radial force;

wherein a direction of a force received by said first helical gear from said second helical gear along a generating line of said image bearing member has substantially the same orientation as a direction of a force received by said third helical gear from the driving helical gear along a generating line of said image bearing member.

2. An apparatus according to claim 1, wherein said rotatable transfer member includes an elastic roller.

3. An apparatus according to claim 1, further comprising urging means, disposed adjacent opposite ends of said rotatable transfer member, for urging the shaft of said rotatable transfer member toward said image bearing member.

4. An apparatus according to claim 1, wherein the shaft of said rotatable transfer member and the shaft of said second helical gear are substantially coaxial.

5. An apparatus according to claim 1, wherein said first helical gear transmits driving force to said second helical gear.

6. An apparatus according to claim 1, wherein said image bearing member is a photosensitive member.

7. An apparatus according to claim 1, wherein said coupling means includes a transmitting portion slidable in a radial direction.

8. An apparatus according to claim 7, wherein said coupling means includes an Oldham's coupling.

9. An apparatus according to claim 1, wherein a force, in a direction of a generating line of said image bearing member, received by said rotatable transfer member from a surface of said image bearing member and a force, in a direction of a generating line of said image bearing member, received by said second helical gear from said first helical gear are opposite in direction from each other so as to apply a tension force to said coupling means.

10. An apparatus according to claim 1, wherein said first and third helical gears have teeth inclined in opposite directions.

11. An apparatus according to claim 1, further comprising a process cartridge containing said image bearing member and said first helical gear, wherein said process cartridge is detachably mountable relative to said image forming apparatus.

12. An apparatus according to claim 1, wherein said rotatable member is supplied with a voltage for image transfer.

13. A process cartridge detachably mountable to a main assembly of an image forming apparatus, comprising:

a movable image bearing member, said image bearing member being contactable to a rotatable transfer member having a shaft mounted on the main assembly, said transfer member functioning to transfer an image from said image bearing member onto a transfer material;

a first helical gear mounted to said image bearing member adjacent an end thereof, said first helical gear being engageable with a second helical gear on the shaft of said transfer member; and a third helical gear, provided adjacent an end of said image bearing member, for receiving a driving force from a driving helical gear mounted in said main assembly;

wherein said main assembly further comprises coupling means, arranged between a shaft of said second helical gear and the shaft of said rotatable transfer member, for transmitting a rotational force from said second helical gear to said rotatable transfer member substantially without transmitting a radial force; and wherein a direction of a force received by said first helical gear from said second helical gear along a generating line of said image bearing member has substantially the same orientation as a direction of a force received by said third helical gear from the driving helical gear along a generating line of said image bearing member.

14. An apparatus according to claim 13, wherein said first helical gear transmits a driving force to said second helical gear.

15. An apparatus according to claim 13, wherein said image bearing member is a photosensitive member.

16. An apparatus according to claim 13, wherein said coupling means includes an Oldham's coupling.

17. An apparatus according to claim 13, wherein said first and third helical gears have teeth inclined in opposite directions.

18. An apparatus according to claim 13, wherein said rotatable member is supplied with a voltage for image transfer.

19. A process cartridge according to claim 13, wherein said process cartridge includes a process means actable on said image bearing member.

20. A process cartridge according to claim 19, wherein said process means includes at least one of a charger, a developing device and a cleaning device.

* * * * *

UNITED STATES PATENT AND TRADEMARK OFFICE

CERTIFICATE OF CORRECTION

PATENT NO. : 5,432,590
DATED : July 11, 1995
INVENTOR(S) : Nomura, et. al.

It is certified that error appears in the above-indentified patent and that said Letters Patent is hereby corrected as shown below:

Title page, item [56], Foreign Patent Documents, delete "1199023 10/1989 Japan".

Column 4, line 24, "roller" should read --roller 33,--
Column 24, line 24, before "photosensitive" insert -- the --.
Column 24, line 25, "36" should read --36,--
Column 6, line 62, "6" should read --6,--

Signed and Sealed this

Twenty-fourth Day of October, 1995

*Attest:*

Bruce Lehman

BRUCE LEHMAN

*Attesting Officer*

*Commissioner of Patents and Trademarks*